US005233937A

United States Patent [19]

Matsumoto

[11] Patent Number: 5,233,937

[45] Date of Patent: Aug. 10, 1993

[54] BALLAST TANK INTERNAL GAS CONTROLLING TYPE TANKER

[75] Inventor: Tsunenobu Matsumoto, Nagasaki, Japan

[73] Assignee: Mitsubishi Jukogyo Kabushiki Kaisha, Tokyo, Japan

[21] Appl. No.: 963,424

[22] Filed: Oct. 19, 1992

[30] Foreign Application Priority Data

Oct. 21, 1991 [JP] Japan ..... 3-301047

[51] Int. Cl.[5] ..... B63B 25/08

[52] U.S. Cl. ..... 114/74 R; 114/211

[58] Field of Search ..... 114/74 R, 74 T, 74 A, 114/211, 212

[56] References Cited

FOREIGN PATENT DOCUMENTS 86129 8/1958 Denmark ..... 114/74 R 30700 2/1982 Japan ..... 114/74 R 23377 9/1910 United Kingdom ..... 114/211

*Primary Examiner*—Jesûs D. Sotelo

*Attorney, Agent, or Firm*—McGlew and Tuttle

[57] ABSTRACT

In a ballast tank internal gas controlling type tanker in accordance with the present invention which comprises an inert gas main pipe 1*a* which supplies inert gas from an inert gas generator 1 to a cargo oil tank via a fan 2 and a ballast main pipe 5 which sucks ballast water from the bottom of a ballast tank 11 via a suction bell-mouth, an air intake pipe 3 is installed which can be connected to the fan 2 by selectively switching over from the inert gas generator 1, and a connecting pipe 4 having a valve is interposed between the ballast main pipe 5 and the inert gas main pipe 1*a*, so that a gas which is allowed to flow into the inert gas main pipe 1*a* from one of either the inert gas generator 1 or the air intake pipe 3 via the fan 2 is transferred to the ballast main pipe 5 to control the internal gas in the ballast tank 11.

2 Claims, 2 Drawing Sheets

BALLAST TANK INTERNAL GAS CONTROLLING TYPE TANKER

FIELD OF THE INVENTION AND RELATED ART STATEMENT

The present invention relates to a ballast tank internal gas controlling type tanker and more particularly to a ballast tank internal gas controlling type tanker in which the oxygen concentration in a ballast tank internal gas is decreased as safety measures against the cargo oil leaking into the ballast tank in the event of crack formation in a cargo oil tank of a tanker, or the internal gas is replaced with fresh air for workers to perform maintenance work in the ballast tank. More particularly, the present invention relates to a tanker suitable for double hull system which has a ballast tank at the side of and under a cargo oil tank.

FIG. 3 shows the controlling means for controlling the internal gas in a ballast tank 11 in a conventional double hull tanker. The ballast tank 11 has an L-shaped transverse cross section and is disposed at the side of and under a cargo oil tank 15. In this ballast tank 11, fresh air is admitted into the ballast tank 11 through a canvas duct 13 depending into the ballast tank 11 from a portable fan 12, which is mounted at the opening of upper deck.

As the fresh air is admitted into the ballast tank 11, the air in the ballast tank is replaced with the fresh air and discharged through an exhaust portion 14 on the upper deck.

The above-described conventional ventilating means which is a combination of the portable fan 12 and the canvas duct 13 poses the following problems: When fresh air is to be admitted into the ballast tank for workers to carry out maintenance work in the ballast tank 11, much labor is required for preparatory work of installing the fan 12 and the canvas duct 13. Also, only the portion directly under the fan 12 can be ventilated; therefore the ventilation at the inner part of ballast tank is insufficient, which interferes with the maintenance work.

In the event that the cargo oil leaks from the cargo oil tank 15 to the ballast tank 11, explosion-proof measures of decreasing the oxygen concentration in the ballast tank 11 must be taken by admitting inert gas. The above-described ventilating means, which is a combination of the portable fan 12 and the canvas duct 13, cannot provide such explosion-proof measures.

OBJECT AND SUMMARY OF THE INVENTION

This invention is intended to solve these problems. Accordingly, an object of the present invention is to provide a ballast tank internal gas controlling type tanker in which the supply of inert gas and the supply of fresh air to the ballast tank can be selectively performed as necessary by using the ballast water discharge system from the ballast tank and the inert gas supply system to the cargo oil tank which are installed as existing equipment in the ordinary tanker, so as to properly control the internal gas in the ballast tank.

To attain the above object, in a ballast tank internal gas controlling type tanker in accordance with the present invention which comprises an inert gas main pipe which supplies inert gas from an inert gas generator to a cargo oil tank via a fan and a ballast main pipe which sucks ballast water from the bottom of a ballast tank via a suction bell-mouth, an air intake pipe is installed which can be connected to the fan by selectively switching over from the inert gas generator, and a connecting pipe having a valve is interposed between the ballast main pipe and the inert gas main pipe, so that a gas which is allowed to flow into the inert gas main pipe from one of either the inert gas generator or the air intake pipe via the fan is transferred to the ballast main pipe to control the internal gas in the ballast tank.

Also, in the tanker in accordance with the present invention, the suction bell-mouth is installed at the inner part of the ballast tank which is farthest from the exhaust portion at the upper part of the ballast tank to replace the existing gas in the ballast tank with the gas transferred to the ballast main pipe by using the suction bell-mouth.

In the tanker in accordance with the present invention, when fresh air is admitted into the ballast tank for workers to carry out the maintenance work of the ballast tank, the air taken from the air intake pipe by means of the fan is allowed to flow in the inert gas main pipe, and then transferred to the ballast main pipe through the connecting pipe. Then, the air transferred to the ballast main pipe is allowed to flow into the ballast tank via a ballast branch pipe by using the suction bell-mouth.

Since the suction bell-mouth is disposed at the inner part of the ballast tank which is farthest from the exhaust portion at the upper part of the ballast tank, the ventilation in the ballast tank can be performed sufficiently, by which workers can carry out the maintenance work in a safe environment.

In the event that cargo oil leaks into the ballast tank due to the crack formation in the cargo oil tank, the inert gas allowed to flow in the inert gas main pipe from the inert gas generator by means of the fan is transferred to the ballast main pipe through the connecting pipe, and admitted into the ballast tank via the ballast branch pipe and the suction bell-mouth. This decreases the oxygen concentration in the ballast tank, by which the explosion-proof measures are implemented.

DETAILED DESCRIPTION OF PREFERRED EMBODIMENTS

Figure 1:
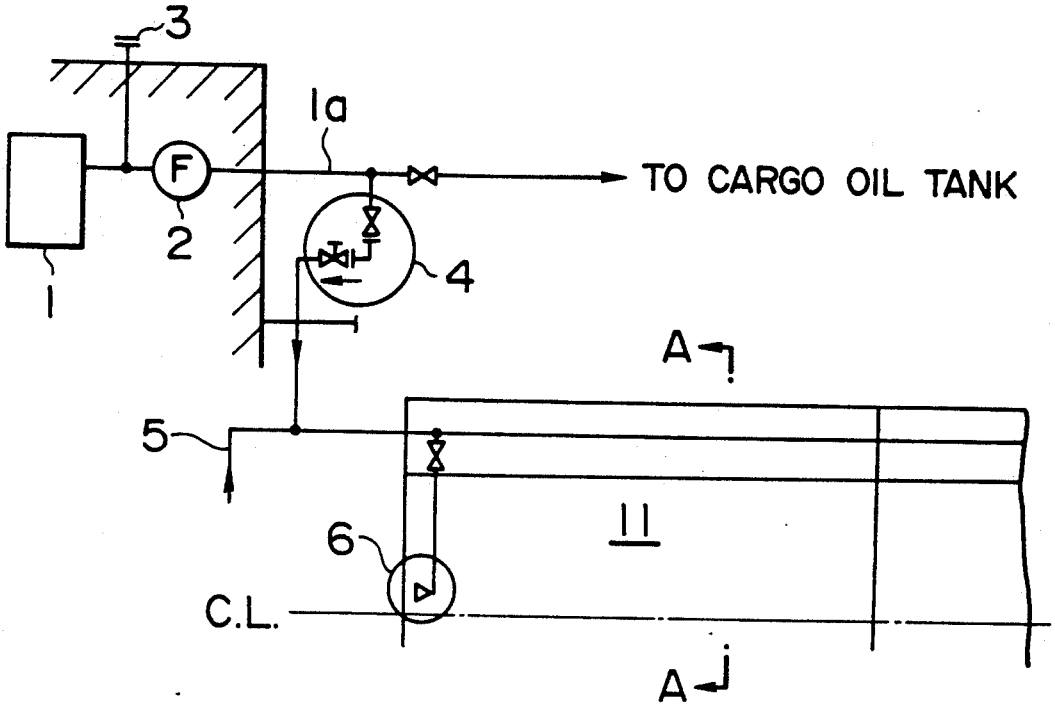
FIG. 1 is a schematic view showing the main part of a ballast tank internal gas controlling type tanker, which is an embodiment of the present invention.

An embodiment of a ballast tank internal gas controlling type tanker in accordance with the present invention will be described with reference to the drawings. FIG. 1 is a schematic view showing the main part thereof, and FIG. 2 is a sectional view taken on the plane of the line A—A of FIG. 1.

Figure 2:
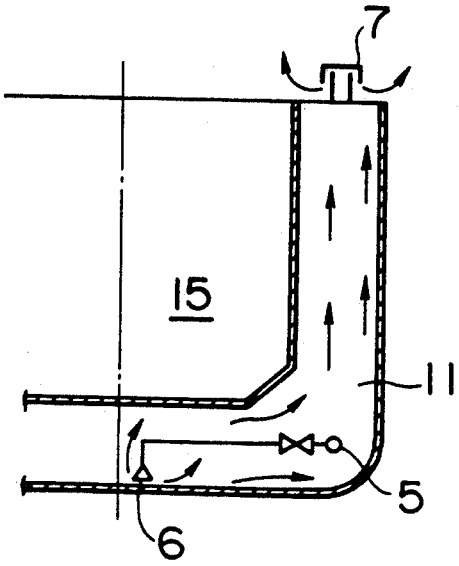
FIG. 2 is a sectional view taken on the plane of the line A—A of FIG. 1.
Figure 3:
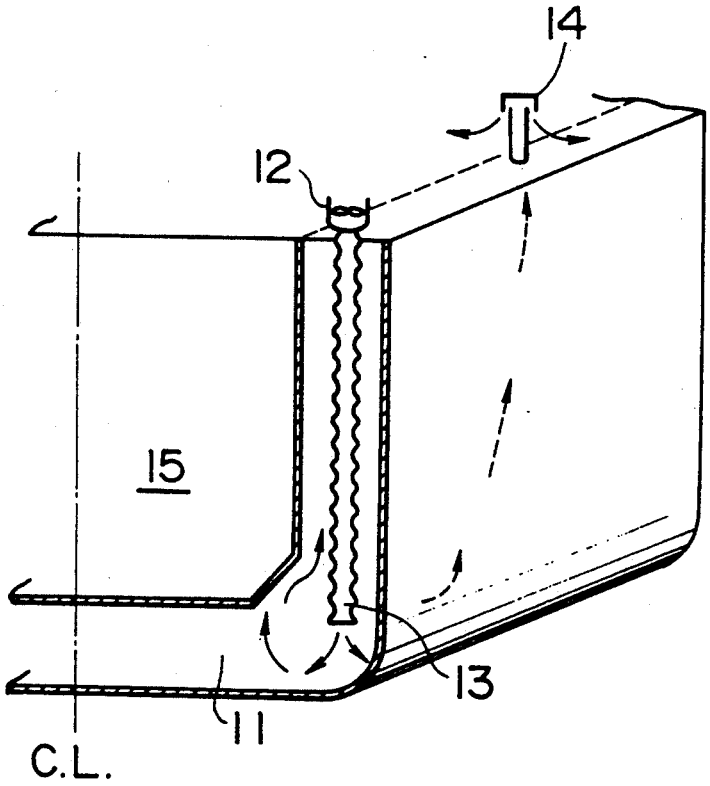
FIG. 3 RELATED ART
FIG. 3 is a partially sectioned perspective view schematically showing a ventilating means for a ballast tank of a conventional tanker.

As shown in FIGS. 1 and 2, a tanker of this embodiment is of a double hull system, in which a ballast tank 11 of L-shaped cross section is disposed at the side of and under a cargo oil tank. This tanker has an inert gas main pipe 1*a* which can supply inert gas from an inert gas generator 1 to the cargo oil tank 15 via a fan 2.

This tanker also has a ballast main pipe 5 which sucks ballast water from the bottom of the ballast tank 11 through a suction bell-mouth 6 by using a not illustrated ballast pump.

In addition, this tanker is provided with an air intake pipe 3 which is connected to the fan 2 by selectively switching over from the inert gas generator 1. To selectively connect either of the inert gas generator 1 or the air intake pipe 3 to the fan 2, a valve (not shown) may be used as a switching means.

A connecting pipe 4 having a valve is interposed between the ballast main pipe 5 and inert gas main pipe 1*a* so that the gas (inert gas or air) flowing into the inert gas main pipe 1*a* from the inert gas generator 1 or the air intake pipe 3 via the fan 2 can be sent to the ballast main pipe 5.

The suction bell-mouth 6 is disposed at the inner part of the ballast tank 11 which is farthest from an exhaust portion 7 at the upper part of the ballast tank 11 so that the existing gas in the ballast tank 11 can be sufficiently replaced with the gas sent to the ballast main pipe 5 through the connecting pipe 4.

According to the above construction, when fresh air is admitted into the ballast tank 11 for workers to carry out the maintenance work of the ballast tank 11, the air taken from the air intake pipe 3 by means of the fan 2 is allowed to flow in the inert gas main pipe 1*a*, and then transferred to the ballast main pipe 5 through the connecting pipe 4. Then, the air transferred to the ballast main pipe 5 is allowed to flow into the ballast tank 11 via a ballast branch pipe and the suction bell-mouth 6.

Since the suction bell-mouth 6 is disposed at the inner part of the ballast tank 11 which is farthest from the exhaust portion 7 at the upper part of the ballast tank 11, the ventilation in the ballast tank 11 can be performed sufficiently, by which workers can carry out the maintenance work in a safe environment.

In the event that cargo oil leaks into the ballast tank 11 due to the crack formation in the cargo oil tank 15, the inert gas allowed to flow in the inert gas main pipe 1*a* from the inert gas generator 1 by means of the fan 2 is transferred to the ballast main pipe 5 through the connecting pipe 4, and admitted into the ballast tank 11 via the ballast branch pipe and the suction bell-mouth 6. This decreases the oxygen concentration in the ballast tank 11, by which the explosion-proof measures are implemented.

As described above, the ballast tank internal gas controlling type tanker comprises an inert gas supply system which includes the inert gas generator 1 and the inert gas main pipe 1*a* connected to the inert gas generator 1 via the high-capacity fan 2 and a ballast water discharge system including the ballast main pipe 5 and the suction bell-mouth 6. The above-mentioned inert gas supply system and the ballast water discharge system are provided in the ordinary tanker. In the tanker in accordance with the present invention, the air intake pipe 3 and the connecting pipe 4 are combined with these two systems, so that the control operation of internal gas can be carried out efficiently and surely; specifically, the preparatory work for maintenance is performed by supplying fresh air to the ballast tank 11, or safety measures against leakage of cargo oil are taken. Particularly for double hull tankers, the control of internal gas can be appropriately carried out even at the inner part of the ballast tank.

As described above, the ballast tank internal gas controlling type tanker of the present invention achieves the following effects:

(1) Using the inert gas supply system for cargo oil tank and the ballast water discharge system for ballast tank which the ordinary tankers are provided with as the existing equipment, the preparatory work for maintenance by the admission of fresh air in the ballast tank and the explosion-proof measures by the admission of inert gas can be surely implemented by merely combining the air intake pipe and the connecting pipe with these systems.

(2) The internal gas in the ballast tank can be controlled rapidly by using a high-capacity fan for inert gas.

(3) The above effects (1) and (2) significantly shorten the period during which the tanker is not in service because of the maintenance of ballast tank.

(4) The conventional portable fan is unnecessary, and the fan is fixed; the fixed fan can be operated quickly even in an emergency.

(5) The ventilating operation in which the existing gas in the ballast tank is replaced with fresh air can be carried out efficiently and sufficiently during the maintenance work because the suction bell-mouth is positioned at the inner part of the ballast tank which is farthest from the exhaust portion at the upper part of the ballast tank even when the ballast tank has an L-shaped transverse cross section, for example, in a double hull tanker.

I claim:

1. A ballast tank internal gas controlling tanker comprising an inert gas main pipe which supplies inert gas from an inert gas generator to a cargo oil tank via a fan and a ballast main pipe which sucks ballast water from the bottom of a ballast tank via a suction bell-mouth, wherein an air intake pipe is installed which can be connected to said fan by selectively switching over from said inert gas generator, and a connecting pipe having a valve is interposed between said ballast main pipe and said inert gas main pipe, so that a gas which is allowed to flow into said inert gas main pipe from one of either said inert gas generator or said air intake pipe via said fan is transferred to said ballast main pipe to control the internal gas in said ballast tank.

2. A ballast tank internal gas controlling tanker according to claim (1), wherein a suction bell-mouth is installed at the inner part of said ballast tank which is farthest from an exhaust portion at the upper part of said ballast tank to replace the existing gas in said ballast tank with the gas transferred to said ballast main pipe by using said suction bell-mouth.

* * * * *